US005338224A

United States Patent [19]

Blanke et al.

[11] Patent Number: 5,338,224

[45] Date of Patent: Aug. 16, 1994

[54] LABELLING DEVICE FOR ELECTRICAL TERMINAL BLOCKS

[75] Inventors: Uwe Blanke, Detmold; Hans J. Kern, Lemgo; Friedrich Schmidt, Lage; Thomas Hanke, Paderborn; Peter E. Murray, Detmold; Michael Schnatwinkel, Herford; Manfred Wilmes, Detmold, all of Fed. Rep. of Germany

[73] Assignee: Weidmuller Interface GmbH & Co., Fed. Rep. of Germany

[21] Appl. No.: 997,215

[22] Filed: Dec. 28, 1992

[30] Foreign Application Priority Data

Jan. 18, 1992 [DE] Fed. Rep. of Germany ..... 4201217

[51] Int. Cl.[5] ..... H01R 9/00

[52] U.S. Cl. ..... 439/491; 439/488; 24/17 AP

[58] Field of Search ..... 434/488–491, 434/718, 937, 885; 24/543, 580, 17 AP, 30.5 P, 3 M; 40/664, 668, 669, 663

[56] References Cited

U.S. PATENT DOCUMENTS

| | | | |
|---|---|---|---|
| 2,548,104 | 4/1951 | Frison | 40/668 |
| 3,416,200 | 12/1968 | Daddona, Jr. | 24/580 |
| 3,729,780 | 5/1973 | White | 24/543 |
| 4,422,708 | 12/1983 | Birnholz | 439/937 |
| 4,441,233 | 4/1984 | Swift | 24/30.5 P |
| 4,514,882 | 5/1985 | Lavielle | 24/30.5 P |
| 4,637,676 | 1/1987 | Simonsen et al. | 439/488 |
| 4,669,688 | 6/1987 | Itoh et al. | 439/543 |
| 5,056,197 | 10/1991 | Cohen | 24/543 |

FOREIGN PATENT DOCUMENTS

| | | | |
|---|---|---|---|
| 3929905 | 10/1990 | Fed. Rep. of Germany | 439/491 |

OTHER PUBLICATIONS

Weidmuller Catalog, 1990, p. 8/15.

*Primary Examiner*—Larry I. Schwartz
*Assistant Examiner*—Hien D. Vu
*Attorney, Agent, or Firm*—Laubscher & Laubscher

[57] ABSTRACT

A labelling device for electrical terminal blocks is characterized by a unitary labelling element including a base portion which can be connected with the insulated body of the block and a tag portion connected with the base portion in a swingable manner via a strap hinge. When the tag portion is folded to the closed position, it is connected with the base portion via a pin and aperture press-fit connection. The labelling device can be manufactured in a simple manner with a narrow design and reliably retained in the closed position, whereby it also functions to cover the access openings of the terminal block.

11 Claims, 2 Drawing Sheets

LABELLING DEVICE FOR ELECTRICAL TERMINAL BLOCKS

BACKGROUND OF THE INVENTION

The present invention relates to a labelling device for electrical terminal blocks including a base portion that can be fastened with a label carrier receiver of the insulating material body of the terminal block and a tag portion that is swingably connected with the base portion and that can be positioned on the narrow topside of the terminal block.

BRIEF DESCRIPTION OF THE PRIOR ART

It is known in the art to provide two-piece labelling devices for electrical terminal blocks as shown in the 1990 Weidmuller Catalog, page 8/15. The base portion, which is provided with a fastening mechanism for fixing the base on the terminal block, is connected with a label carrier via a swing joint connection. When in the operative position, the label carrier rests loosely on the narrow top surface of the terminal block.

The two-piece labelling devices of the prior art require a large amount of space for joining and separating the base and label carrier. The space requirement is difficult to accommodate with present terminal blocks which are being constructed in more compact and narrower configurations. Furthermore, the prior two-piece labelling devices are difficult and expensive to manufacture.

The present invention was developed in order to overcome these and other drawbacks of the prior art by providing a terminal block labelling device which can be made in a simple manner as a unitary, narrow structure and which can be positioned for use in a simple and reliable manner.

SUMMARY OF THE INVENTION

Accordingly, it is a primary object of the present invention to provide a labelling device for an electrical terminal block including integral base, hinge, and tag portions. The base portion is adapted for connection with the insulated body of the terminal block and the tag portion is adapted for movement between open and closed positions via the hinge portion. The base portion includes an aperture for receiving a pin projecting from the tag portion to retain the tag portion in the closed position. When so positioned, the tag portion displays a labelling area adjacent the narrow top portion of the terminal block.

According to a preferred embodiment of the invention, the base portion includes a lug which contains the aperture and the tag portion includes a recess from which the pin projects. The lug is arranged within the recess when the tag portion is in the closed position. The pin, aperture, lug, and recess thus define a press-fit connection.

The labelling device of the invention may be formed as a strip of a plurality of laterally spaced devices with the tag portions connected at their free ends via a common strip containing a removable tear strip.

According to another object of the invention, the base and hinge portions of the labelling device are formed of a synthetic plastic material having a high elasticity and the tag portion is formed of a brittle material at least at the free end thereof.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
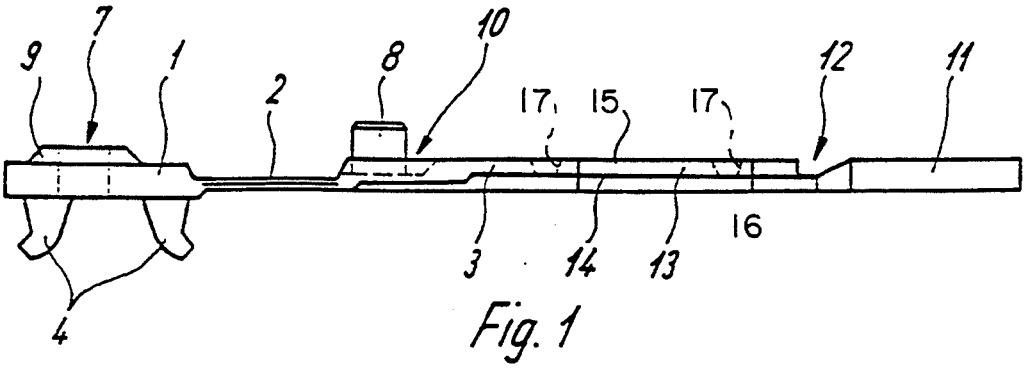
FIG. 1 is a side plan view of the terminal block labelling device according to the invention in its open position.
Figure 2:
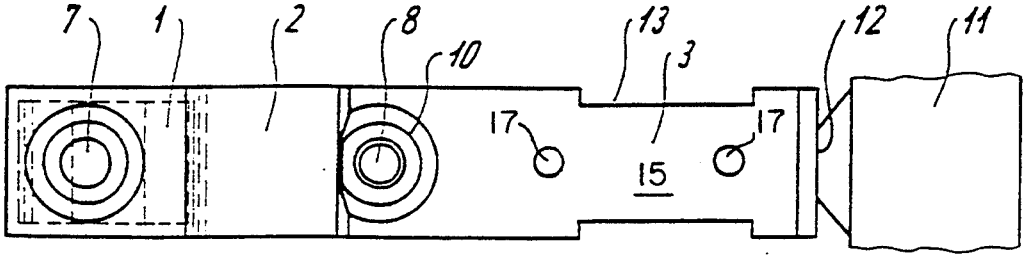
FIG. 2 is a top plan view of the labelling device of FIG. 1.
Figure 3:
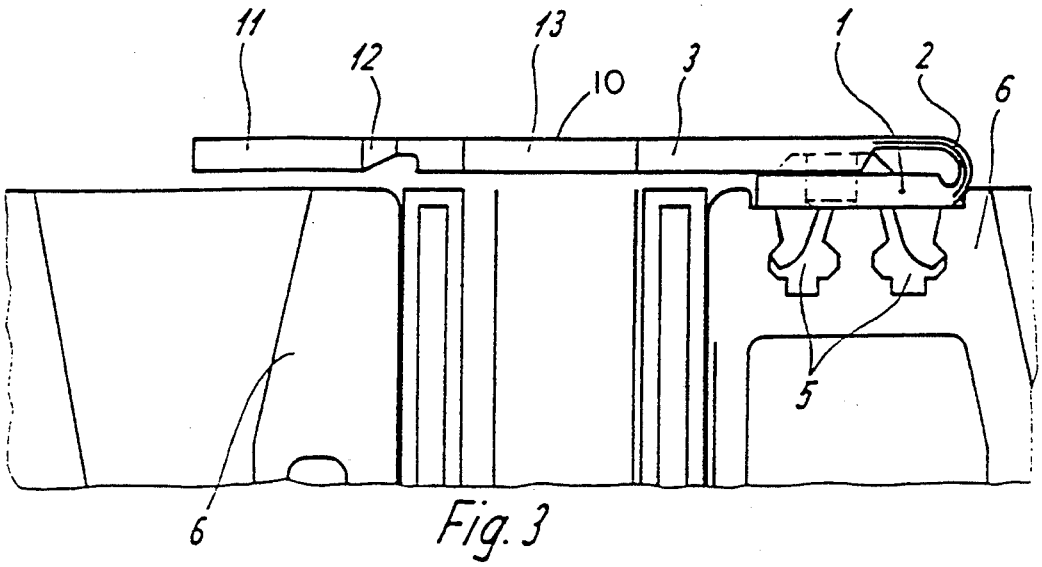
FIG. 3 is a side plan view of the labelling device in its closed position and arranged on the upper narrow side of a terminal block.

The electrical terminal labelling device is shown in the open position in FIGS. 1 and 2 and has a base portion 1 with which is connected a labeling tag portion 3 that can be moved between open and closed positions in a swinging motion. The base and tag portions have a unitary construction owing to a hinge strap portion 2 made as a film hinge. The base portion 1 has catches or prongs 4 by means of which the base portion 1 can be connected with conventional catch grooves 5 that are present in the accessible narrow topside of the insulating material body 6 of electrical terminal blocks as shown in FIG. 3. The usually small labeling carrier elements can also be snapped into these catch grooves 5.

In the example shown, the base portion 1 of the labelling device contains an engagement aperture 7 with which cooperates a catch pin 8 provided in a corresponding location on the tag portion 3. In the closed position of the labelling device as shown in FIG. 3, the tag portion 3 is swung around, by means of the hinge portion 2, upon the base portion 1. The catch pin 8 enters into the catch aperture 7. Owing to the catch or press-fit connection, the tag portion of the labelling device in the closed position lies reliably over the narrow topside of the insulating body 6 of the terminal block and functions to cover the usual access openings located therein for the cross-connection elements, the operating tools, the test plugs, and the like.

To enhance the press-lit connection between the base and tag portions and retain them in the closed position, the base portion 1 includes a round lug 9 through which the aperture 7 extends. In the tag portion is provided a round recess 10 from which the pin 8 protrudes. Thus, the lug 9 receives the recess 10 when the device is in the closed position.

Figure 4:
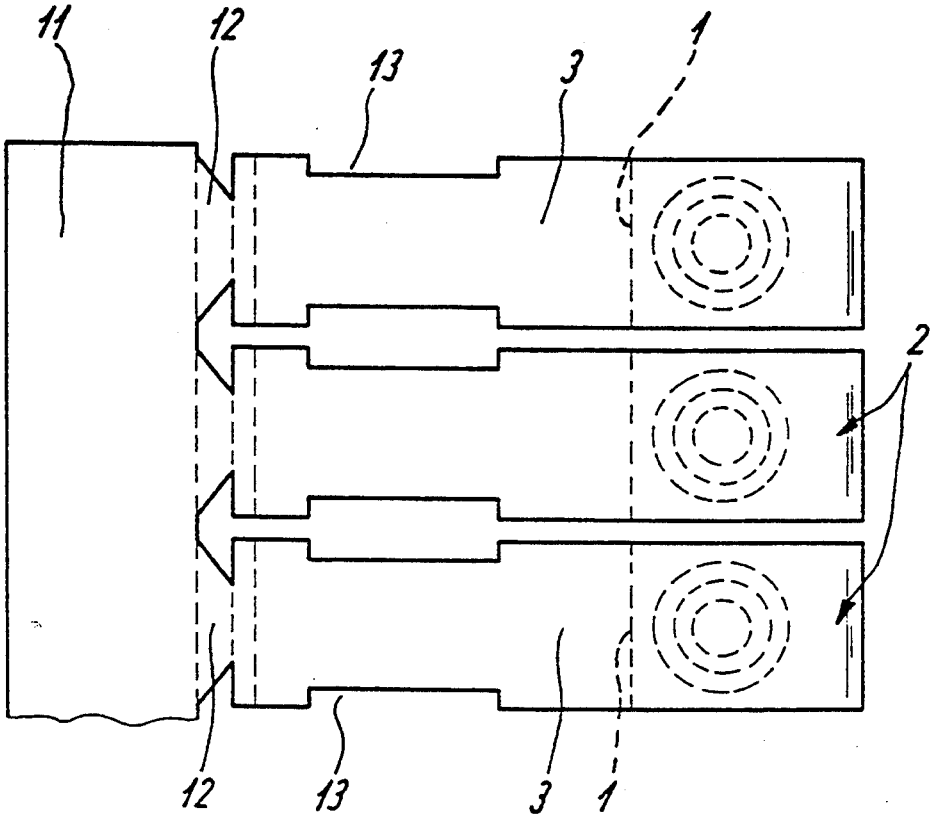
FIG. 4 is a partial top plan view of a labelling device strip with several parallel tag portions shown in the closed position.

Referring now to FIG. 4, there is shown a labelling device strip which is formed with a plurality of labelling devices arranged in spaced parallel relation for ease of manufacture and handling. In this embodiment, the adjacent labelling devices have their free ends interconnected via a common cross-connection strip 11. The common strip includes a removable tear strip 12 which is integrally molded with the common strip and the interconnected tag portions.

The cross-connection strip enables a plurality of labelling tag portions to be simultaneously positioned upon a row of terminal blocks and connected thereon by means of the base portion 1. In such a case, the cross-connection strip can De left on the labelling devices and the user has the possibility of fully or partially using the surface of the cross-connection strip which is in the field of vision as an additional labeling surface. The user also has the possibility of separating individual labelling devices via the tear strip 12 from the common cross-connection strip and arranging them individually on the terminal blocks for connection therewith. Various possibilities exist for attaching actual labels upon label designation areas of the tag portion 3. The top and bottom labeling surfaces 15, 16, visible in the open and closed positions, can be printed directly with label designations. It is also possible to provide catch grooves 17 in the tag portion, similar to the catch grooves 5, and then placing in the grooves the usual small label carrier pieces in a desired arrangement.

Label markings on the tag portion can be placed not only on the label designation surface that can be seen when it is in the closed position, but also on the inner or top surface 15. The markings or labels on the top surface 15 naturally are visible only after the labelling device has been opened. Opening of the device is accomplished by lifting the pin 8 on the tag portion from the aperture 7 in the base portion. As a result of the inseparable connection of the tag portion 3 and base portion 1 by film hinge strap portion 2 with the tag portion 3 always held on the terminal block, alignment of the labels with the terminal is preserved in each case.

As set forth above, the label tag portion 3 of the labelling device has a protective function when in the closed position. As illustrated in FIG. 3, it also covers the cross connection of a terminal block arrangement. In order to ensure the visibility of the area of the terminal block that is under the label tag portion 3 when in the closed position, there are provided recesses 13 on the longitudinal sides of the label tag portion 3 in another practical design.

The labelling device is preferably formed from two different raw materials that are connected with each other in an inseparable fashion during an injection molding process. As shown in FIG. 1 by means of the separation line 14, the base portion 1 and hinge strap portion 2 and a part of the area of the tag portion 3 are made of a synthetic plastic material having high elasticity values. Another area of the tag portion 3, especially its top labelling surface 15, is formed of a synthetic plastic material with particularly good adhesion properties as regards printing placed thereon. This raw material is also particularly brittle in order to facilitate separation from the joint connector strip.

Due to the elimination of any kind of assembly steps, the integral connection between the base and tag portions leads to a simplified, inexpensive manufacturing process for the labelling device while providing a very narrow design in view of the hinge strap connection. By locking the base portion and the tag portion in their closed position—in which the label tag portion then covers up the narrow topside of the terminal block—one can reliably hold the labelling device in its user position upon the terminal block. The device also reliably covers the diverse access openings in the narrow topside of the terminal block which still remain accessible due to the separability of the connection between the tag portion and the base portion for the operating tools, the test plug, the cross-connection pieces, or the like.

In the version of FIG. 4, a labelling strip is provided in which several labelling devices are molded next to each other with their free ends connected via a common cross-connection strip having a removable tear strip. This design helps simplify the manufacturing process because a large number of labelling devices can be formed next to each other in the form of a billet and, if necessary, the cross-connection strip functions as a handling aid. Thus, the user can arrange a plurality of individual labelling devices simultaneously upon a terminal block and lock the devices thereon by means of the base portions. In this design, there is also the possibility of leaving the cross-connection strip on the marking elements following assembly. The visible surface areas of the cross-connection strip can also be used as labeling surfaces. On the other hand, it is possible to separate the individual labelling devices via the tear strip from the cross-connection strip and then connects the labelling devices individually with the terminal blocks concerned.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. A labelling device for an electrical terminal block, comprising (a) a base portion (1) including a plurality of prongs adapted for connection with an insulated body of the terminal block;

(b) a hinge portion (2) integrally connected with said base portion;

(c) a tag portion (3) integrally connected with said hinge portion for movement between open and closed positions via said hinge portion;

(d) means (7, 8) on said base and tag portions, respectively, for retaining said tag portion in said closed position, whereby when a label is placed on said tag portion and said tag portion is arranged in its closed position, said tag portion displays the label adjacent a narrow top portion of the terminal block;

e) wherein said base portion includes a lug (9) extending from a surface of said base portion opposite said prongs and containing an aperture (7); and f) wherein said tag portion includes a latch pin (8) projecting from a first recess (10), said pin engaging said aperture and said lug engaging said recess to retain said tag portion in the closed position.

2. A labelling device as defined in claim 1, wherein said hinge portion comprises a film hinge.

3. A labelling device as defined in claim 1, wherein said tag portion includes longitudinal recesses (13) within side portions thereof.

4. A labelling device as defined in claim 1, wherein said tag portion includes label designation areas on at least one of a top surface and a bottom surface.

5. A labelling device as defined in claim 1, wherein said tag portion includes means on at least one of a top surface and a bottom surface for receiving a label.

6. A labelling device as defined in claim 1, and further comprising a plurality of integral laterally spaced labelling elements connected at the free ends of said tag portions thereof via a common strip (11) containing a removable tear strip (12).

7. A labelling device as defined in claim 6, wherein said common strip has at Least one label designation surface.

8. A labelling device as defined in claim 1, wherein said base, hinge, and tag portions are formed of different raw materials.

9. A labelling device as defined in claim 8, wherein said base and hinge portions are formed of a synthetic plastic material having a high elasticity.

10. A labelling device as defined in claim 8, wherein said tag portion has an upper surface formed of a material having a high adhesion for retaining a print placed thereon.

11. A labelling device as defined in claim 8, wherein a free end of said tag portion is formed of a brittle material.

* * * * *